US005501121A

United States Patent [19]

Beier et al.

[11] Patent Number: 5,501,121

[45] Date of Patent: Mar. 26, 1996

[54] CAMSHAFT ARRANGEMENT HAVING A CAM MOUNTED FOR LIMITED ANGULAR MOTION

[75] Inventors: Alfred Beier, Braunschweig; Dietrich Distler, Wolfsburg; Adamis Panaqiotis, Wolfsburg; Paul Gnegel, Wolfsburg, all of Germany

[73] Assignee: Volkswagen AG, Wolfsburg, Germany

[21] Appl. No.: 213,128

[22] Filed: Mar. 15, 1994

[30] Foreign Application Priority Data

Mar. 15, 1993 [DE] Germany ..... 43 08 130.4

[51] Int. Cl.[6] ..... F16H 53/00

[52] U.S. Cl. ..... 74/568 R; 74/567; 123/90.17; 123/90.6

[58] Field of Search ..... 74/567, 568 R, 74/569; 123/90.17, 90.6; 29/888.1

[56] References Cited

U.S. PATENT DOCUMENTS

| | | | |
|---|---|---|---|
| 4,870,872 | 10/1989 | Parsons | 123/90.17 X |
| 5,105,679 | 4/1992 | Voigt | 74/568 R |
| 5,168,772 | 12/1992 | Adamis et al. | 74/568 R |
| 5,239,885 | 8/1993 | Voigt | 74/567 |
| 5,307,768 | 5/1994 | Beier et al. | 123/90.6 X |
| 5,329,890 | 7/1994 | Mueller | 123/90.17 |
| 5,345,898 | 9/1994 | Krebs | 123/90.17 |
| 5,377,559 | 1/1995 | Riley et al. | 74/568 R X |
| 5,404,770 | 4/1995 | Kruger | 74/568 R |

FOREIGN PATENT DOCUMENTS

| | | | |
|---|---|---|---|
| 3234640 | 12/1990 | Germany | 74/568 R |
| 4122251 | 1/1992 | Germany | 74/568 R |
| 1537929 | 1/1990 | U.S.S.R. | 74/568 R |

*Primary Examiner*—Vinh T. Luong
*Attorney, Agent, or Firm*—Brumbaugh, Graves, Donohue & Raymond

[57] ABSTRACT

A camshaft arrangement includes a cam mounted for angular motion on a camshaft with the angular motion being limited by cooperating stops in the camshaft and in a neck portion of the cam defining an interchamber filled with damping fluid. Damping fluid is supplied to the interchamber by a passage in a camshaft bearing sleeve which is in communication with a longitudinal passage in the camshaft through a valve designed to prevent the longitudinal passage from draining.

4 Claims, 2 Drawing Sheets

CAMSHAFT ARRANGEMENT HAVING A CAM MOUNTED FOR LIMITED ANGULAR MOTION

BACKGROUND OF THE INVENTION

This invention relates to camshaft arrangements having cams supported for limited angular motion. German Offenlegungsschrift No. 41 22 251 discloses a camshaft arrangement in which cams supported for limited angular motion are provided with stops formed as claws projecting from a tube extending parallel to the camshaft and held stationary with respect to the cam. Another configuration of cam stops, in which they are beneath the cam rather than extending laterally with respect to the cam, is disclosed in German Patent No. 32 34 640. In that arrangement, the stop is a strip mounted in the camshaft and projecting into an angular recess extending over a selected angle in an inner surface of the cam adjacent to the camshaft so as to define the limits of angular motion of the cam with respect to the camshaft. In one form, the recess is a closed hydraulic system, while in another form a passage having a check valve connects the recess with a passage in the camshaft to provide hydraulic damping fluid to the recess.

The above-mentioned prior art movable cam arrangements provide the advantageous possibility of optimizing an engine valve stroke curve as a function of the rotational speed of the engine during operation. In principle, this is accomplished because the cam is held in fixed position with respect to the camshaft only during certain angular intervals of each camshaft revolution when it rotates at the same speed as the camshaft while, in the other angular intervals, the angular velocity of the cam is greater or less than the rotational speed of the camshaft. Assuming a constant camshaft speed during a revolution, therefore, these arrangements provide angular intervals of uniform and nonuniform rotational motion of the cam.

To the extent that the prior art discloses the use of damping fluid, a longitudinal passage in the camshaft is provided for this purpose, which must, accordingly, be connected to a source of damping fluid. Generally, the lubricating oil supply for the engine is used as the damping fluid and is supplied to the longitudinal passage in the camshaft at a central location in the engine. When the camshaft is comparatively long, however, the flow resistance of the passage may cause pressure losses which adversely affect the damping action in the cam recess. The adverse effect of this pressure loss is especially noticeable when the engine generates a comparatively low oil pressure in its lubricating system as, for example, when it is idling.

SUMMARY OF THE INVENTION

Accordingly, it is an object of the present invention to provide a camshaft arrangement having cams mounted for limited angular motion which overcomes the disadvantages of the prior art.

Another object of the invention is to provide such a camshaft arrangement in which damping fluid is supplied at the required pressure to the cam recesses for all of the cams mounted on the camshaft.

These and other objects of the invention are attained by providing a camshaft arrangement having a cam which is angularly movable thereon and a stationary bearing sleeve surrounding the camshaft having a fluid passage therein communicating with the camshaft passage through which hydraulic damping fluid is supplied to a recess in which a cam motion-limiting stop member is movable.

One important advantage of the camshaft arrangement according to the invention is that it requires practically no additional space since the damping fluid passages are provided in camshaft bearings which are required in any event.

In one embodiment, a check valve prevents damping fluid from draining out of the camshaft passage when the engine is idling. Moreover, the bearing passage may act as a valve if it is arranged to be connected to the camshaft passage by way of a connecting passage only when the cam is at predetermined angles with respect to the camshaft.

In another embodiment, the camshaft bearing may be very narrow in the regions between the cams, or it may be omitted entirely in those regions to save space.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
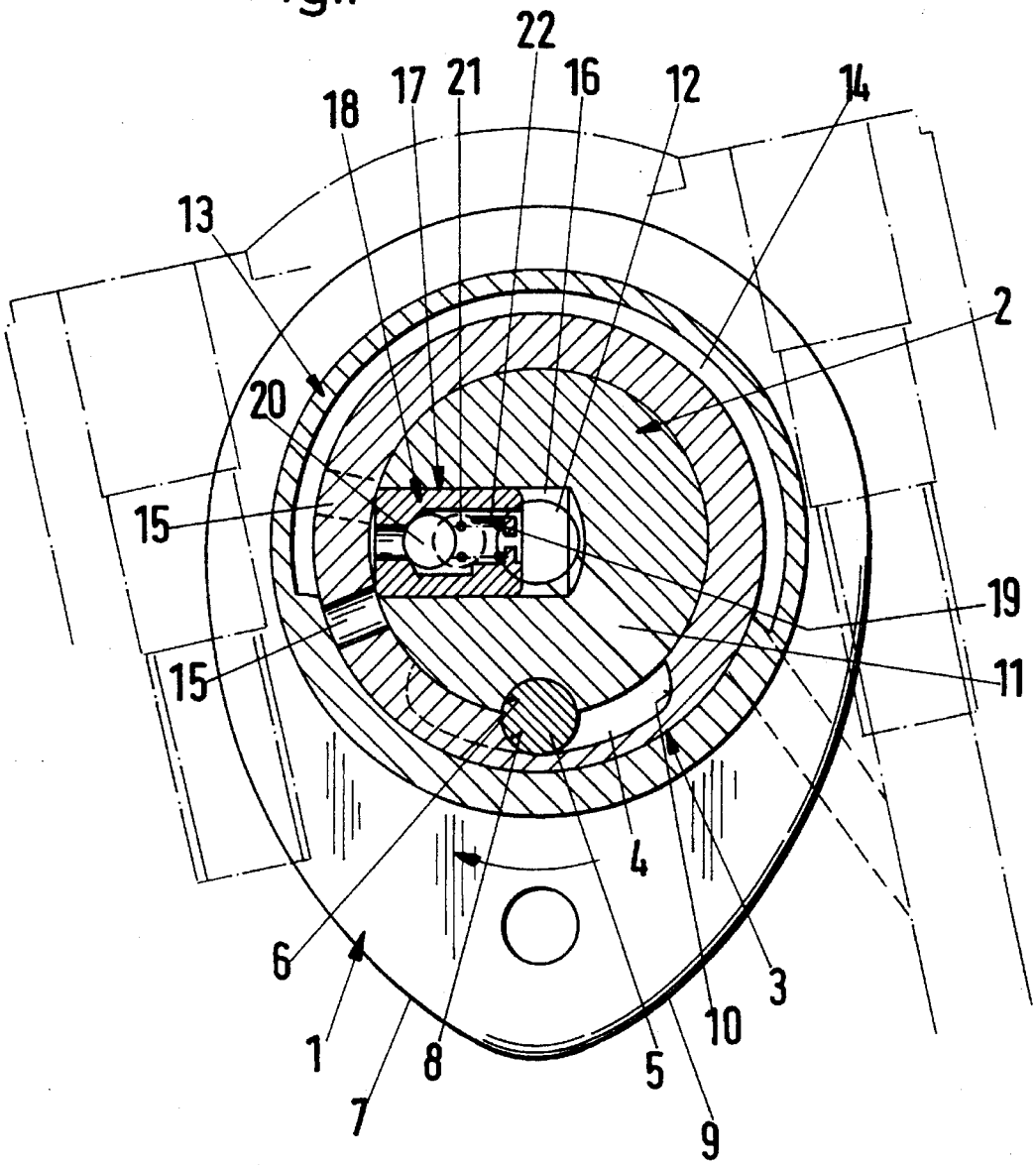
FIG. 1 is a cross-sectional view illustrating a representative embodiment of a camshaft arrangement according to the invention.

In the typical embodiment of the invention shown in FIG. 1, a cam 1 is mounted for limited angular motion on a camshaft 2. The cam 1 is located behind the plane of the drawing which is selected so that a neck 3, which is adjacent to and fixed with respect to the cam, is shown in section in the drawing. The angle of motion of the cam 1 and, hence, also of the neck 3 with respect to the camshaft 2, is determined by the angular length of a recess 4 formed in the inner surface of the neck 3 which receives a roller-shaped driver 5. The driver 5 extends perpendicular to the plane of the drawing and is rotatably received in a correspondingly-shaped recess 6 in the camshaft 2. The driver 5 and the recess 4 preferably extend beneath the cam 1.

When the camshaft 2 rotates in the clockwise direction, as indicated by the arrow in the drawing, the force exerted on a portion 7 of the cam contour at the left as seen in FIG. 1 by the closing spring for the valve which is driven by the cam, produces a driving contact between the driver 5 and a stop surface 8 at the left end of the recess 4 which is fixed with respect to the cam so that the cam 1 rotates at the same angular velocity as the camshaft 2. When the cam has rotated far enough so that the valve-closing spring force acts on the right portion 9 of the cam contour as seen in FIG. 1, and the cam has a relatively low rotational speed, the force of the valve-closing spring produces an angular acceleration of the cam 1 relative to the camshaft 2 moving the cam in the direction of the arrow until a stop surface 10 at the right end of the recess 4 as seen in FIG. 1 engages the cam driver 5. Accordingly, the angular length of the recess 4 in the circumferential direction defines the limits of angular motion of the cam 1 with respect to the camshaft 2. The recess 4 thus forms an interchamber between the camshaft stop formed by the driver 5 and the cam stop 8 at one end of the recess.

To damp the relative motion between the cam and the camshaft, damping fluid is supplied to the recess 4 through a transverse passage 11 from a longitudinal passage 12 in the camshaft 2 when the cam 1 is in the position shown in FIG. 1 so that the flow of damping fluid into the recess 4 is possible.

As described above, the pressure in the longitudinal camshaft passage 12 may not be sufficient to ensure a required pressure build-up in the interchamber 4, at least when the engine is idling. To overcome this problem, a sleeve 13, which is part of a stationary camshaft bearing, is formed with a passage 14 which extends over a preassigned angular interval and is open toward the neck 3. The passage 14 communicates with a source damping of fluid and also communicates at all positions of the cam 1 with respect to the neck 3 by way of a communicating passage 15 therein with a transverse passage 16 in the camshaft. The transverse passage 16 has a check valve 17 permitting flow of the damping fluid from the passages 14 and 15 into the longitudinal camshaft passage 12, but not in the opposite direction. Emptying of the longitudinal passage 12, for example when the engine is idling, is thereby prevented.

In the embodiment illustrated in FIG. 1, the check valve 17 consists of a housing 18 which is pressed into the transverse passage 16 and forms a seat 19 for a valve ball 20 so that, when the pressure in the passage 14 is higher than the pressure in the longitudinal camshaft passage 12, the ball is pressed to the right as seen in FIG. 1 against the force of a valve spring 21, permitting fluid to flow through a bypass duct 22 in the check valve 17.

Figure 2:
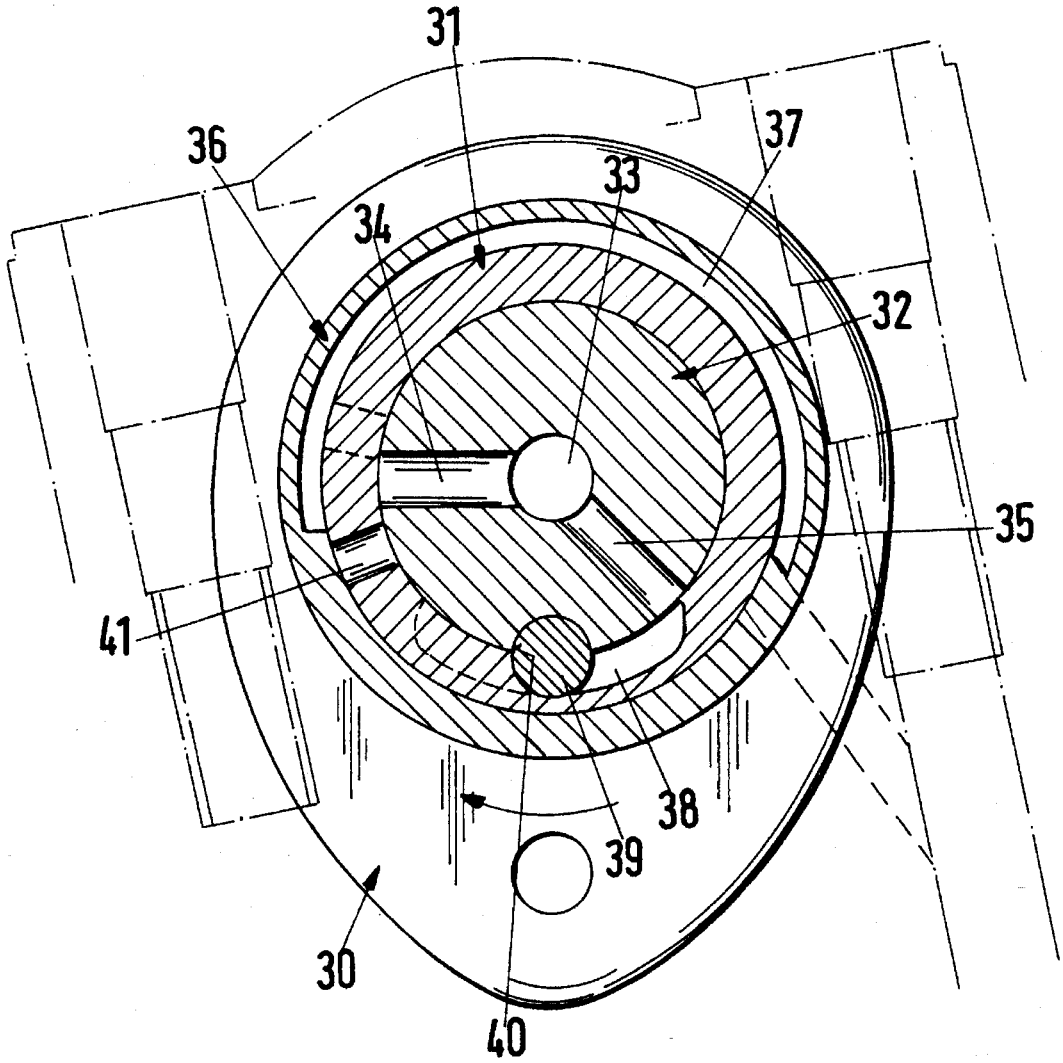
FIG 2 is a cross-sectional view illustrating another representative embodiment of a camshaft arrangement according to the invention.

Referring now to the alternative embodiment shown in FIG. 2, an angularly movable cam 30 also positioned behind the plane of the drawing has a neck 31 and is mounted on a camshaft 32 formed with a longitudinal passage 33 and transverse passages 34 and 35, and the neck 31 is surrounded by a sleeve 36 having an angular passage 37. The neck 31 has a recess 38 which receives a roller-shaped driver 39, which is rotatably supported in a recess 40 in the camshaft 32.

In this embodiment, a check valve such as the check valve 17 in the embodiment of FIG. 1 is dispensed with and, instead, a communicating passage 41 formed in the neck 31 establishes flow communication between the transverse camshaft passage 34 and the angular passage 37 in the sleeve 36 only in certain relative angular positions of the cam 30 and the camshaft 32. Hence it may be said that the neck 31 by itself forms a check valve, by preventing communication between the longitudinal passage 33 in the camshaft 32 and the angular passage 37, for example when the engine is idling. In the operating conditions in which the communicating passage 41 provides a flow connection between the passage 237 and the transverse camshaft passage 34, communication between the recess 38 and the longitudinal camshaft passage 33 through the transverse passage 35 is prevented.

The invention provides, by a simple constructing, a dependable supply of damping fluid for a camshaft arrangement having an angularly movable cam.

Although the invention has been described herein with reference to specific embodiments, many modifications and variations therein will readily occur to those skilled in the art. Accordingly, all such variations and modifications are included within the intended scope of the invention.

We claim:

1. A camshaft arrangement for actuating a lift value provided with a closing spring comprising at least one cam supported for limited angular motion on camshaft and having a neck portion extending from one face of the cam parallel to the camshaft, the angular motion of the cam being limited by opposed stops which are fixed relative to the cam and the camshaft, respectively, and which form at least one interchamber adapted to be filled with a damping fluid, a sleeve bearing for the camshaft surrounding the neck portion and having an internal passage extending over a predetermined angle about the neck portion, the camshaft having longitudinal and transverse passages which are in flow communication with the internal passage in the neck portion and with the interchamber at a predetermined angular position of the cam with respect to the camshaft, the internal passage in the sleeve being arranged to supply damping fluid through the internal passage in the neck portion and the camshaft passages to the interchamber at the predetermined angular position.

2. A camshaft arrangement according to claim 1 wherein the longitudinal passage in the camshaft also serves to supply the damping fluid to the interchamber and the internal passage in the sleeve communicates with the longitudinal camshaft passage through a check valve which permits flow only in the direction toward longitudinal passage.

3. A camshaft arrangement according to claim 1, wherein the longitudinal camshaft passage also supplies the interchamber with damping fluid and the internal passage in the sleeve is in flow communication with the longitudinal camshaft passage through at least one connecting passage in the neck portion only at predetermined angular positions of the neck portion with respect to the sleeve.

4. A camshaft arrangement according to claim 1 wherein the internal passage in the sleeve extends over only a limited angular portion of the sleeve.

* * * * *